United States Patent [19]

Kohus

[11] Patent Number: 4,703,863

[45] Date of Patent: Nov. 3, 1987

[54] BABY FEEDING BOTTLE ASSEMBLY

[75] Inventor: Louis M. Kohus, Cincinnati, Ohio

[73] Assignee: Kohusmariol Inc., Cincinnati, Ohio

[21] Appl. No.: 898,609

[22] Filed: Aug. 21, 1986

[51] Int. Cl.[4] ..... A61J 9/00; A61J 9/06; B65D 23/10

[52] U.S. Cl. ..... 215/11.1; 215/100 A; 220/94 A

[58] Field of Search ..... 215/11 R–11 E, 215/6, 10, 100 A; 220/4 A, 4 D, 94 A, 94 B; D24/47, 48; D9/301, 307

[56] References Cited

U.S. PATENT DOCUMENTS

| | | | |
|---|---|---|---|
| D. 99,270 | 4/1936 | Dache'Despres | D9/307 |
| D. 269,950 | 8/1983 | Walker | D9/405 X |
| D. 284,408 | 6/1986 | Chan | D24/47 |
| 455,516 | 7/1891 | Pfeffer et al. | 215/6 |
| 595,414 | 12/1897 | Roach | 215/11 R |
| 1,434,460 | 11/1922 | Tibbatts | 215/11 R X |
| 1,466,311 | 8/1923 | Mobley | 215/11 R |
| 1,617,213 | 2/1927 | LaPaugh | 215/11 R |
| 2,265,615 | 12/1941 | Stalter | 215/6 X |
| 2,789,002 | 4/1957 | Nicholas | 215/11 R X |
| 2,831,596 | 4/1958 | Eyles | 215/11 R |
| 2,843,281 | 7/1958 | Gallois | 215/6 X |
| 2,986,296 | 5/1961 | Bannister et al. | 215/11 C |
| 3,134,494 | 5/1964 | Quinn | 215/11 E |
| 3,215,297 | 11/1965 | Acton et al. | 215/334 |
| 3,430,798 | 3/1969 | Goyet et al. | 215/295 |
| 3,512,301 | 5/1970 | Kramer | 215/11 C |
| 3,990,596 | 11/1976 | Hoftman | 215/11 R |
| 4,570,808 | 2/1986 | Campbell et al. | 215/11 R |
| 4,600,111 | 7/1986 | Brown | 215/11 R X |
| 4,603,784 | 8/1986 | Chang | 215/6 X |

FOREIGN PATENT DOCUMENTS

| | | | |
|---|---|---|---|
| 585716 | 10/1959 | Canada | 215/11 R |
| 63033 | 10/1982 | European Pat. Off. | 215/11 E |
| 594305 | 5/1959 | Italy | 215/11 R |

*Primary Examiner*—Stephen Marcus
*Assistant Examiner*—Sue A. Weaver
*Attorney, Agent, or Firm*—Dressler, Goldsmith, Shore, Sutker & Milnamow, Ltd.

[57] ABSTRACT

A baby feeding bottle assembly in which a four ounce bottle may be converted to an eight ounce bottle and providing improved means for easy gripping of the bottle assembly by an infant or small child. The baby feeding bottle assembly is elongate and includes two parts. One of the parts may be a baby bottle of a four ounce size, and the other of the parts may be a threaded adaptor having threads at each end so that one end may be secured to the bottle and the other end may be secured with a feeding nipple. When assembled, the assembly defines a generally dumbbell or hourglass configuration generally centrally of the elongate assembly for facilitating gripping by an infant or small child.

10 Claims, 5 Drawing Figures

FIG. 1
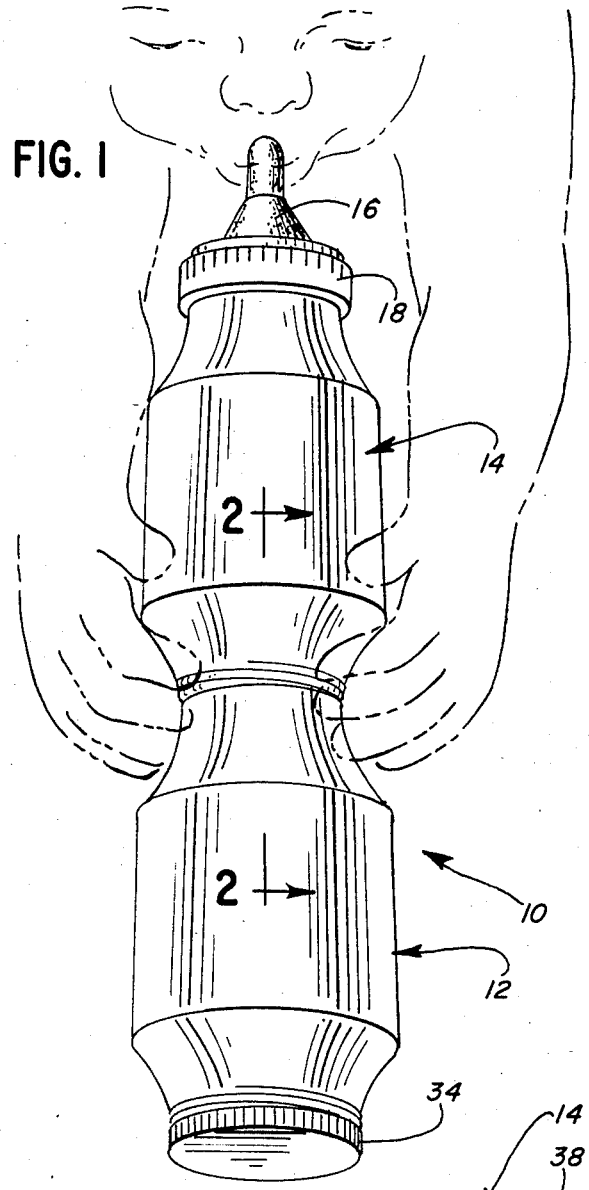
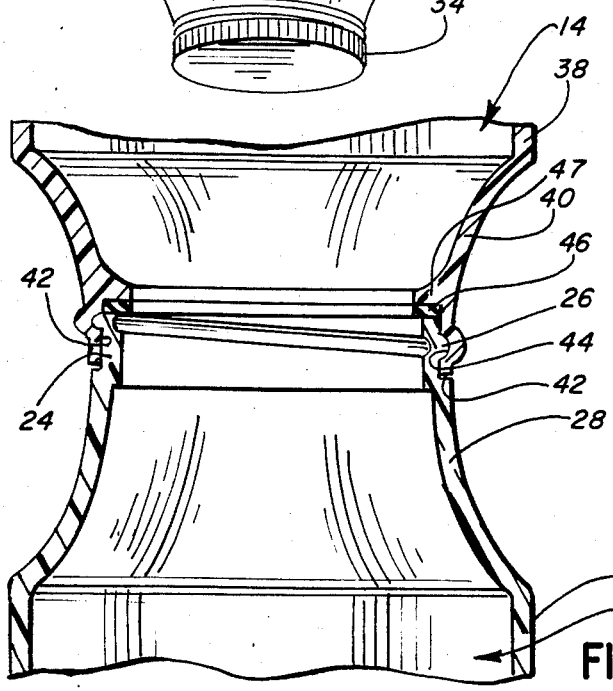
FIG. 2
FIG. 3
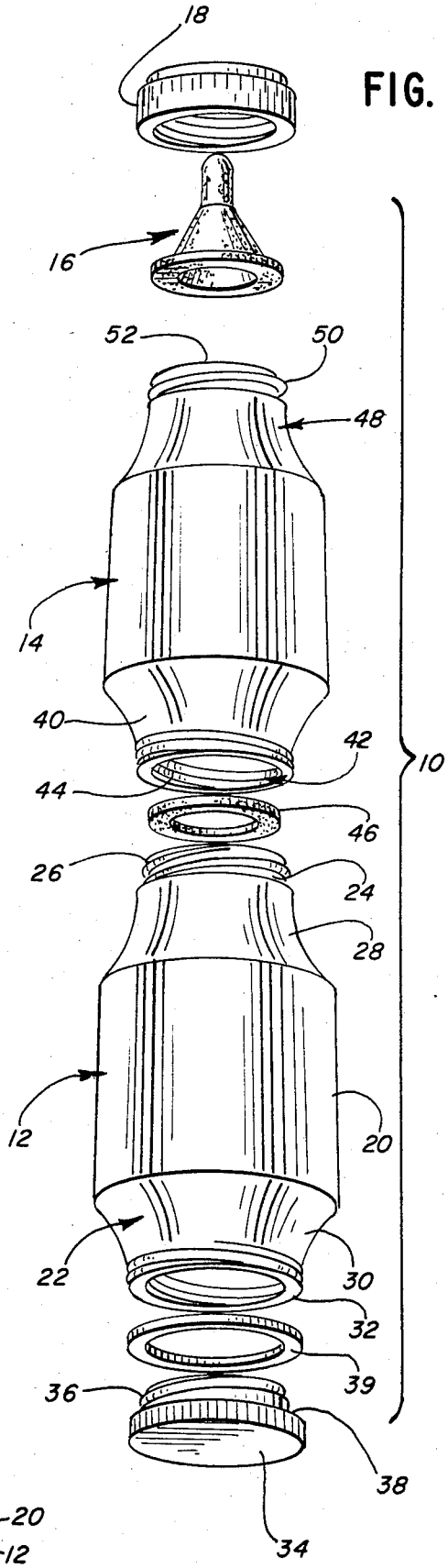

BABY FEEDING BOTTLE ASSEMBLY

BACKGROUND OF THE INVENTION

This invention relates to improvements in baby feeding bottles.

A large number of baby feeding bottles and nursing units have been developed in the past. Typically, these bottles comprise a main body with an integral threaded neck, and a collar for securing a nipple to the threaded neck.

Such bottles are typically generally cylindrical in configuration and are necked down slightly at the neck end of the bottle. Some such bottles are generally polygonal in transverse cross-section through the main body.

Baby feeding bottles generally come in two sizes in the United States. The smaller four ounce size is used initially because the fluid intake of a new-born and small infant is relatively small. As the child grows, the fluid intake per sitting increases to the point where more than four ounces are frequently needed. At that time, four ounce bottles are usually discarded for the second standard size, the eight ounce bottle.

The four ounce size bottle is easier for a small child to handle. However, the eight ounce size is much more difficult for a small child to handle, in part due to the substantially increased weight of the fill of an eight ounce container.

A variety of mechanisms have been developed to facilitate ease of holding of such bottles by the child or infant itself during feeding. A recent patent showing a special configuration for that purpose is Campbell U.S. Pat. No. 4,570,808. Other such patents include Roach U.S. Pat. No. 595,414, Hoftman U.S. Pat. No. 3,990,596, LaPaugh U.S. Pat. No. 1,617,213, Nicholas U.S. Pat. No. 2,789,002, and Bannister U.S. Pat. No. 2,986,296. A patent showing a typical baby bottle or nursing unit is Eyles U.S. Pat. No. 2,831,596. McFarlane EPO Application No. 0063033 discloses a baby bottle assembly having an open bottom for removal of a liner when desired.

It would therefore be of advantage to provide a convertible baby feeding bottle assembly and an improved eight ounce size baby feeding bottle which facilitates self-handling by an infant or small child.

SUMMARY OF THE INVENTION

The present invention contemplates an improved baby feeding bottle assembly in which a four ounce bottle may be converted to, or used as part of, an overall eight ounce bottle, and which, at the same time, provides improved means for easy gripping of the assembly by an infant or small child. To that end, an elongated baby feeding bottle assembly of the present invention comprises two parts, each having a main body section of a first size. One of the parts is adapted itself to serve as a baby feeding bottle and is adapted to contain a first quantity of liquid. It has a threaded upper neck section. The other of the parts is an adaptor for containing a generally like quantity of liquid. It has an upper neck portion and a base portion, each of which portions defines a threaded opening. The assembly defines a gripping section of a second smaller size generally midway of the length of the assembly.

The bottle has threads in the upper neck section, and the adaptor has complementary threads in its base portion for threadingly and sealingly engaging with the threads in the threaded upper neck section of the baby feeding bottle. The upper neck portion of the adaptor is threaded and is adapted for engaging a collar for sealingly securing a nipple to the threaded upper neck portion.

Desirably the upper neck section of the bottle is of the smaller size to facilitate gripping of the assembly in the zone of the upper neck section. The base portion of the adaptor may also be of the smaller size to facilitate gripping of the assembly in the zone of the base. In a preferred form the assembly is of a dumbbell or hourglass configuration and the upper neck section and the base portion each are of a tapering configuration.

The two parts may be substantially the same in configuration, each defining a threaded opening at each end. However, the adaptor may primarily define the dumbbell configuration and therefore the second smaller sized section may be primarily within the adaptor.

Further objects, features and advantages of the present invention will become apparent from the following description and drawings.

BRIEF DESCRIPTION OF THE DRAWINGS

FIG. 1 is a perspective view of a baby feeding bottle assembly in accordance with the present invention;

FIG. 2 is an enlarged fragmentary, vertical cross-sectional view of the assembly of FIG. 1, taken substantially along line 2—2 of FIG. 1;

FIG. 3 is an exploded perspective view of the baby feeding bottle assembly of FIG. 1;

DESCRIPTION OF PRESENTLY PREFERRED EMBODIMENTS

Figure 4:
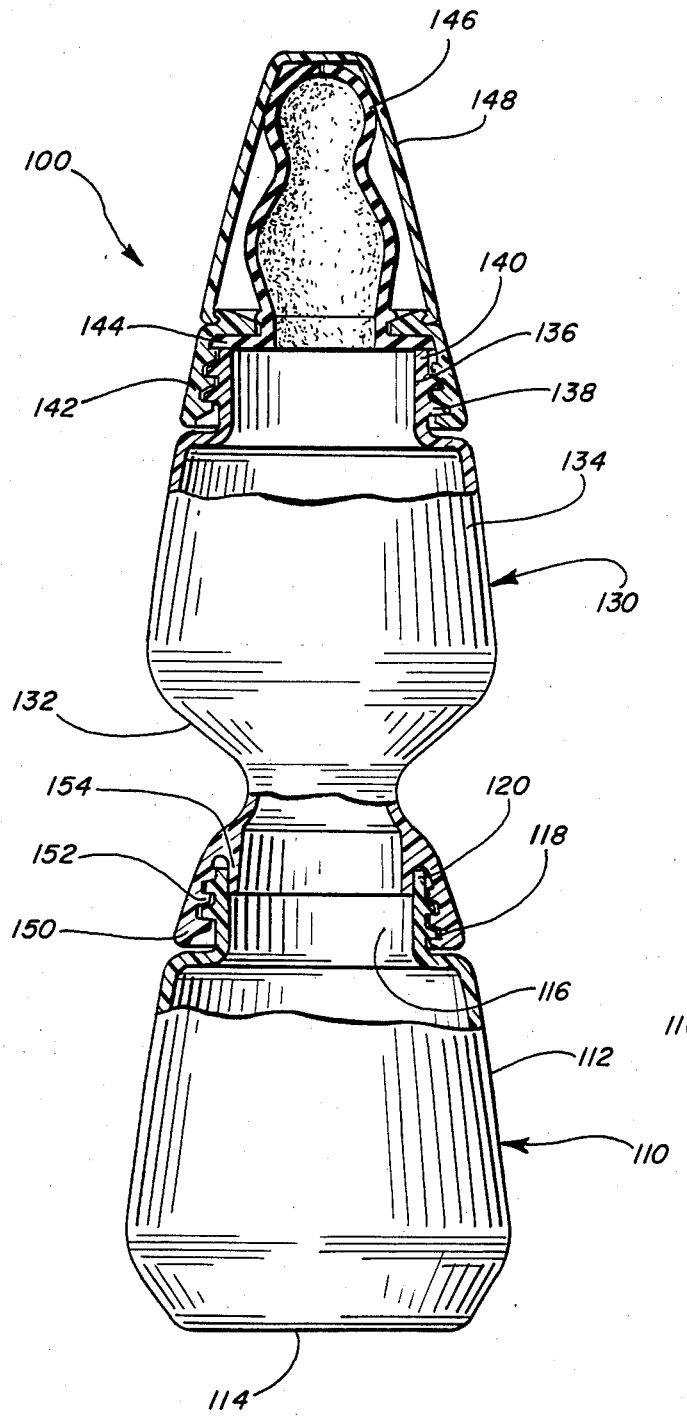
FIG. 4 is a side elevation, partially broken away of a further embodiment of a baby feeding bottle of the present invention.

Referring now to FIGS. 1–3, a two-part baby feeding bottle assembly 10 in accordance with the present invention comprises a lower bottle 12, and an upper adaptor bottle section 14. Each is adapted to contain a generally like quantity of liquid. A nipple 16 and a collar 18 are also provided.

Lower bottle 12 may be a conventional four ounce bottle having a generally cylindrical or polygonal main body, a base or bottom, a tapering upper end, and a threaded neck. Alternatively, as shown in the drawings, the lower bottle 12 may be of a four ounce size and may have a generally cylindrical main body 20 of a first size, a tapered bottom 22, a threaded upper neck 24 having threads 26, and a tapering upper neck section 28 of a smaller size than the main body. The threaded upper neck 24 is adapted to be threadedly secured at the base of the adaptor bottle section 14. The tapered bottom 22 comprises a tapering lower portion 30, an internally threaded mouth 32 and a collar or plug 34. Plug 34 defines threads 36 which are complementary to, and sealingly mate with, the threads of internally threaded mouth 32. The plug has an upper land area 38 upon which a flat rubber washer 39 is adapted to be seated. Washer 39 is positioned to seal against the mouth 32 when the threads are tightened thereby to provide a supplemental positive seal.

The adaptor bottle section 14 comprises a main body section of a first size and includes a tapering lower base including base portion 40 of a smaller size than the main body. The base portion defines a generally centrally located opening 42 which is provided with internal threads 44 which are complementary to threads 26. The threads 26, 44 are adapted to sealingly secure the lower bottle 12 to the upper adaptor section 14. To enhance the sealing of the bottle 12 and section 14, a washer 46 is provided. Washer 46 is proportioned to be seated on the upper end of neck 24 and to sealingly engage shoulder 47 (FIG. 2) at the lower end of section 14 when the threads are engaged.

The upper end of the adaptor bottle section 14 may be conventionally configured, as with a suitable tapering neck section 48 and with threads 50 on the neck. A nipple 16 is adapted to be sealingly secured to the mouth 52 of the adaptor section 14. The nipple is adapted to be sealingly secured against the mouth 52 by the collar 18 which is threaded with threads which are complementary to the threads 50 of the adaptor bottle section 14.

It will be apparent, in the embodiment illustrated in FIGS. 1–3, that the lower bottle 12 and upper adaptor bottle section 14 may be substantially the same in construction, and therefore may be interchangeable. The adaptor bottle section 14 thus may also be a nominal four ounce container. As such, the combined lower bottle 12 and adaptor bottle section 14 are adapted together to contain eight ounces of milk or other liquid to be consumed by a baby.

As shown by the drawings, to make use of an assembly in accordance with the present invention, it is only necessary to provide a lower bottle section which may be conventional, or which may be as illustrated, with an adaptor bottle section 14. The adaptor bottle section 14 is threadingly secured to the lower bottle 12, which is closed with the plug 34, and in that form is ready for use as an eight ounce bottle. For cleaning, if desired, the two sections may be separated, and then reassembled. When only a four ounce serving is desired, the lower bottle section 12 may be used with the collar 18 and the nipple 16.

It will be apparent from the drawings that the tapering neck section 28 of the lower bottle 12 is reduced in dimension, as is the tapering base section 40 of the adaptor section 14, so that when assembled, the bottle assembly may be readily grasped by the hands and fingers of an infant or small child. By contrast it would be relatively much more difficult or even impossible for a very small child to grip or hold a bottle 12 or adaptor section 14 in the zone of its full size or diameter.

It is apparent that where the lower end portion of the adaptor bottle section 14 is also tapered inwardly and downwardly, it will provide what may be loosely referred to as an hourglass or dumbbell configuration. That serves, where desired, to facilitate the ease of gripping of a baby bottle assembly 10 of the present invention in the zone of the upper neck of the bottle 12 and in the base portion of the adaptor 14.

Figure 5:
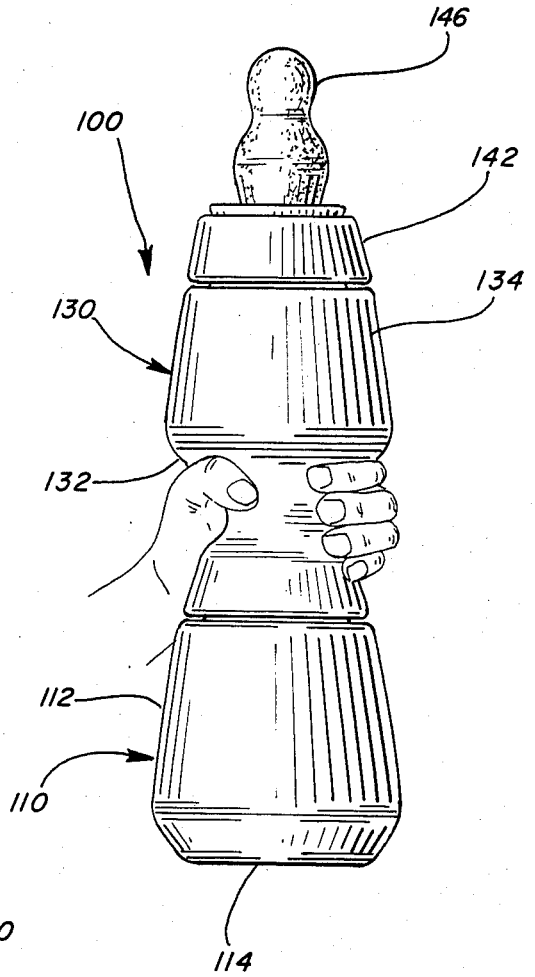
FIG. 5 is a view of FIG. 4 showing how a small child might grip the bottle assembly of FIG. 4.

As was stated above, the lower four ounce bottle may be of a more conventional type, such as one which is formed with a closed bottom. In the embodiment of FIGS. 4 and 5 such a bottle is provided for use with an upper adaptor section.

Referring now to FIGS. 4 and 5, a further embodiment of a baby feeding bottle assembly in accordance with the present invention is there shown. Baby bottle assembly 100 may comprise a lower bottle 110 which may be of a four ounce size and which may have a sculptured main body section 112. Thus, the major portion of the main body 112 tapers generally upwardly and inwardly, whereas the lower portion of the main body 112 tapers downwardly and inwardly to its closed bottom 114. The main body terminates at its upper end in a threaded upper neck 116 having threads 118 and a mouth portion 120.

The upper bottle portion 130 is sculptured. It defines a lower hourglass section 132 of a second smaller size to facilitate gripping, an upper section 134 of a first larger size which tapers upwardly and inwardly and terminates in a threaded neck 136. Threaded neck 136 defines external threads 138 and a mouth 140.

Mouth 140 is adapted to threadingly receive and cooperate with a nipple collar 142 and to capture the sealing shoulder 144 of nipple 146. A protective cap 148 is adapted to be snap engaged to the nipple collar 142 in a conventional manner.

The base 150 of the hourglass section 132 of upper bottle 130 is internally threaded with threads 152. Threads 152 cooperatingly mate with threads 118 on neck 116. Desirably threads 118 and threads 138 are substantially identical so that the nipple collar 142 as well as the lower end of upper bottle 130 may be threadingly secured with the threads 118 and with neck 116.

The lower end of hourglass section 132 also defines an annular sealing lip 154. Sealing lip 154 and the zone of the upper bottle portion 130 bearing the threads 152 are positioned and proportioned so that when the lower bottle is threadingly engaged with the upper bottle portion 130, and tightened with respect thereto via threads 118 and 152, the mouth portion 120 will be sealingly positioned between the lower end of the upper bottle 130 and the sealing lip 154. Providing a seal in that fashion will eliminate the need for a washer or other seal, such as that which is shown in the embodiment of FIGS. 1–3.

Thus, the lower bottle or bottle section 110 will be usable as a four ounce bottle. However, when it is desired to use that bottle as a portion of an eight ounce bottle, an adaptor bottle section, such as the upper bottle 130, may simply be threadingly secured to the lower bottle section to produce an eight ounce bottle. The nipple and nipple collar 142 which is shown in association with the upper bottle adaptor section 130 may previously have been used with the lower bottle section 110. The bottle sections are easy to sealingly secure to each other without auxiliary parts, and are easy to dissemble.

As stated, the configuration of the assembled lower and upper bottle sections presents a configuration which is of an hourglass or dumbbell type. The lower most end portion 132 is tapered and configured so that it smoothly continues the contour of the upper portion of main body 112 of lower bottle 110.

The bottle of FIGS. 4 and 5, as shown in FIG. 4, may be readily and easily gripped by a young child, and with one hand, indeed as may be the embodiment of FIGS. 1–3. An advantage of the hourglass or dumbbell configuration is that when it is gripped, as with one hand, it will not tend to rotate as bottles having eccentric handles will, such as bottles of the type shown in Campbell U.S. Pat. No. 4,570,808.

From the foregoing, it will apparent to those skilled in the art that further modifications may be made and provided without departing from the spirit of the invention. Accordingly, the scope of the present invention is to be considered as being limited only to the extent made necessary by the claims appended hereto.

What is claimed is:

1. An elongated baby feeding bottle assembly comprising two parts, each part having a main body section of a first size, said assembly defining a gripping second of a smaller second size generally midway of the length of said assembly, one of said parts being adapted itself to serve as a baby feeding bottle and adapted to contain a first quantity of liquid, and having an upper neck section, said upper neck section having threads, and the other of said parts being an adaptor for containing a generally like quantity of liquid, and having an upper neck portion and a base portion, each of which portions has an opening and threads, said threads in said adaptor base portion being for threadingly and sealingly engaging with, and being complementary to, the threads in said upper neck section, and the threads in said upper neck portion being adapted for engaging a collar for sealingly securing a nibble to said threaded upper neck portion.

2. A baby feeding bottle assembly in accordance with claim 1, and wherein said baby feeding bottle and said adaptor are substantially the same in construction.

3. A baby feeding bottle assembly in accordance with claim 1, and wherein said bottle upper neck section is of said second smaller size to facilitate gripping of said assembly in the zone of said bottle upper neck section.

4. A baby feeding bottle assembly in accordance with claim 3, and wherein said base portion is of said second smaller size to facilitate gripping of said assembly in the zone of said base portion.

5. A baby feeding bottle assembly in accordance with claim 4, and wherein each of said bottle upper neck section and adaptor base portion is of a tapering configuration.

6. A baby feeding bottle assembly in accordance with claim 4, and wherein said assembly is generally of a dumbbell configuration.

7. A baby feeding bottle assembly in accordance with claim 6, and wherein said dumbbell configuration is primarily defined by said adaptor.

8. A baby feeding bottle assembly in accordance with claim 1, and wherein each of said two parts is substantially the same in configuration, and wherein each of said parts defines an opening with threads at each end.

9. A baby feeding bottle assembly in accordance with claim 1, and wherein said assembly is generally of a dumbbell configuration and said dumbbell configuration is defined primarily by the lower portion of said adaptor.

10. A baby feeding bottle assembly in accordance with claim 1, and wherein said adaptor defines a sealing lip in its base portion confronting said complementary threads and proportioned to cooperate with said threads to seal the mouth of the upper threaded neck section of said one of said parts.

* * * * *